US008303289B2

(12) United States Patent
Goller et al.

(10) Patent No.: US 8,303,289 B2
(45) **Date of Patent: *Nov. 6, 2012**

(54) DEVICE AND METHOD FOR HOT ISOSTATIC PRESSING CONTAINER

(75) Inventors: George Albert Goller, Greenville, SC (US); Raymond Joseph Stonitsch, Simpsonville, SC (US); Jason Robert Parolini, Greer, SC (US); Daniel Y. Wei, Reading, MA (US)

(73) Assignee: General Electric Company, Schenectady, NY (US)

( * ) Notice: Subject to any disclaimer, the term of this patent is extended or adjusted under 35 U.S.C. 154(b) by 392 days.

This patent is subject to a terminal disclaimer.

(21) Appl. No.: 12/546,168

(22) Filed: Aug. 24, 2009

(65) Prior Publication Data

US 2011/0044840 A1 Feb. 24, 2011

(51) Int. Cl.
*B29C 43/02* (2006.01)
*B28B 3/00* (2006.01)

(52) U.S. Cl. ..... 425/77; 425/405.2

(58) Field of Classification Search ..... 425/77, 425/78, 405.1, 405.2

See application file for complete search history.

(56) References Cited

U.S. PATENT DOCUMENTS 4,582,681 A 4/1986 Asari et al.
4,602,952 A 7/1986 Greene et al.
4,935,198 A * 6/1990 Tornberg ..... 419/8
4,938,673 A 7/1990 Adrian
6,718,809 B1 4/2004 Utyashev et al.
2004/0052671 A1 3/2004 Okuda
2004/0081572 A1 4/2004 Bampton et al.
2006/0026833 A1 2/2006 Imbourg et al.

OTHER PUBLICATIONS

Search Report from corresponding EP Application No. 10173248.5-2122 dated May 13, 2011.

Yuan et al., "Computer Modelling and Tooling Design for Near Net Shaped Components Using Hot Isostatic Pressing", Journal of Materials Processing Technology, Elsevier, NL, vol. 182, No. 1-3, Nov. 8, 2006, pp. 39-49, XP005753361.

R. Baccino et al., "High Performance and High Complexity Net Shape Parts for Gas Turbines: The ISOPREC Powder Metallurgy Process", Materials and design, London, GB, vol. 21, No. 4, Jan. 1, 2000, pp. 345-350, XP008041918.

* cited by examiner

*Primary Examiner* — Richard Crispino
*Assistant Examiner* — Thukhanh Nguyen
(74) *Attorney, Agent, or Firm* — Dority & Manning, P.A.

(57) ABSTRACT

An improved method and container for forming billets using hot isostatic pressing is provided. The improved method and container have features that control the deformations of the container during the high temperatures and pressures experienced in such processing so as to provide a billet having a predetermined shape such as, for example, substantially parallel, convex, and/or concave sides. Conservations of the powder used for the billet and more efficient use of the container upon the resulting billet can be achieved.

5 Claims, 5 Drawing Sheets

DEVICE AND METHOD FOR HOT ISOSTATIC PRESSING CONTAINER

FIELD OF THE INVENTION

The subject matter disclosed herein relates to an improved method and container for forming billets using hot isostatic pressing and, more specifically, to a method and container having features that control the deformations of the container during the high temperatures and pressures experienced in such processing so as to provide a billet with sides having a predetermined shape or position.

BACKGROUND OF THE INVENTION

Metallurgical techniques have been developed for the manufacture of a metal billet or other object from metal powders created in a predetermined particle size by e.g., microcasting or atomization. Usually highly alloyed with Ni, Cr, Co, and Fe, these powders are consolidated into a dense mass approaching 100 percent theoretical density. The resulting billets have a uniform composition and dense microstructure providing for the manufacture of components having improved toughness, strength, fracture resistance, and thermal expansion coefficients. Such improved properties can be particularly valuable in the fabrication of e.g., rotary components for a turbine where high temperatures and/or high stress conditions exist.

The consolidation of these metal powders into a dense mass typically occurs under high pressures and temperatures in a process referred to as hot isostatic pressing (HIP). Typically, the powders are placed into a container (sometimes referred to as a "can") that has been sealed and its contents placed under a vacuum. The container is also subjected to an elevated temperature and pressurized on the outside using an inert gas such as e.g., argon to avoid chemical reaction. For example, temperatures as high as 480° C. to 1315° C. and pressures from 51 MPa to 310 MPa or even higher may be applied to process the metal powder. By pressurizing the container that is enclosing the powder, the selected fluid medium (e.g., an inert gas) applies pressure to the powder at all sides and in all directions.

The equipment required for HIP treatment is typically very costly and requires special construction. Due to the extreme temperatures and pressures, the container is substantially deformed or crushed as the volume of the powder decreases during the HIP process and the container becomes joined to the surface of the billet created by the compacted powder. Depending upon the desired shape for the resulting billet, all or portions of the surface of the container may be cut away i.e., by machining after the HIP process. In addition, portions of the billet may also be cut away depending upon the shape desired and the nature of deformations that occurred during the HIP process. Given that the powder used to manufacture the billet is typically very expensive, removal of portions of the billet is undesirable. A process that allows for shape control during compaction while optimizing the removal of material from the billet is needed.

FIGS. 1 and 2 provide an exemplary illustration of the problems confronted using conventional containers in the HIP process. FIG. 1 provides a schematic illustration of a portion of a container 101 before being subjected to the extreme temperature and pressure of the HIP process. Container 101 encloses the powder mixture 105 intended for compaction and provides a seal to prevent the ingress of the fluid used for pressurization e.g., argon during the HIP process. Before pressurization, the walls 110 between top 100 and bottom 135 are basically straight and/or without deformation. Top 100 and bottom 135 are also undeformed before the HIP process.

FIG. 2 illustrates the same portion of container 101 after being subject to the HIP process. The conditions of the HIP process have now converted the powder into a metal billet 106. However, the change in density from powder to a solid metal has also resulted in a rather dramatic change in volume. As the volume decreased, container 101 also deformed with the change from powder 105 to billet 106. FIG. 2 illustrates that wall 110 has now taken on an arcuate shape, and top 100 and bottom 135 may undergo deformations as well. As a result, billet 106 also has a similar shape sometimes referred to as an hour-glass shape.

Unfortunately, depending upon the shape desired for billet 106 (or the shape of the ultimate component to be constructed from billet 106), the deformations shown in FIG. 2 may be undesirable because the resulting shape for billet 106 may require the removal of valuable material from its surface. For example, assuming a cylindrical outer surface is needed along wall 110 of billet 106, container 101 and billet 106 may need to be cut i.e., machined along line 130 in order to obtain the desired outer surface. However, in addition to the destruction of container 101, significant amounts of the billet 106 will be lost at portions 115 along the top and bottom of container 101. Because of the substantial costs of the original powder, this loss is undesirable. In addition, although less significant than the powder costs, portions of container 101 are also lost as a result of the machining process. In certain applications, it may be desirable to retain the material of container 101 on the resulting billet for inclusion on the final work piece. In such cases, removal of the container to shape the billet is to be avoided.

Therefore, an improved method and device that provides for the reduction or elimination of powder loss in connection with HIP treatment would be useful. An improved method and device that also provides for a billet having a predetermined shape such as e.g., substantially parallel, convex, or concave sides would also be useful. Finally, an improved method and device that also can allow for the retention of all or desired portions of the container upon the billet for inclusion in the intended work piece would also be useful.

BRIEF DESCRIPTION OF THE INVENTION

The present invention provides an improved method and container for forming billets using hot isostatic pressing and, more specifically, to a method and container having features that control the deformations of the container during the high temperatures and pressures experienced in such processing so as to provide a billet having a predetermined shapes such as e.g., substantially parallel, convex, or concave sides. Additional aspects and advantages of the invention will be set forth in part in the following description, or may be obvious from style description, or may be learned through practice of the invention.

In one exemplary embodiment, a container for compaction processing of a powder into a billet is provided. The container defines an axial direction and includes a container top, a container bottom, and an outer wall. The outer wall is located between the contain top and bottom and connects the same so as to define an interior for the receipt of the powder. The outer wall has a top portion and a bottom portion. The top and bottom portions of the outer wall angle away from the interior of the container to form a non-zero angle $\alpha$ from the axial direction. The angle $\alpha$ is selected so that after compaction processing the top and bottom portions will be located at predetermined positions to provide a selected shape for the billet.

In another exemplary aspect of the present invention, a method for optimizing the use of material during hot isostatic pressing is provided. This exemplary method includes the steps of providing a container for the receipt of a powder intended for compaction. The container defines an axial direction and includes a top, a bottom, and an outer wall connecting the top and the bottom to define an interior of the container. The outer wall includes a top portion and a bottom portion. The top portion and bottom portion of the outer wall are positioned away from the interior of the container so as to form a non-zero angle $\alpha$ from the axial direction. This exemplary method includes determining a nonzero value for angle $\alpha$ such that during hot isostatic pressing the top portion and the bottom portion of the container will deform to predetermined positions relative to the axial direction of the container.

Another exemplary embodiment of the present invention provides a container for compaction processing of a powder into a billet. The container defines an axial direction and has a middle. The container includes a container top, a container bottom, and an outer wall located between and connecting the container top and the container bottom to define an interior for the receipt of the powder. The outer wall has a top portion and a bottom portion with each of these portions having a taper whereby the thickness of each portion decreases along the axial direction and towards the middle of the container.

In still another exemplary embodiment of the present invention, a method for optimizing the use of material during hot isostatic pressing is provided. The method includes the steps of providing a container for the receipt of a powder intended for compaction. The container defines an axial direction and includes a top, a bottom, and an outer wall connecting the top and the bottom to define an interior of the container with the container having a middle. The outer wall includes a top portion and a bottom portion. A taper is formed along each of the portions whereby the thickness of each of the portions decreases in a manner along the axial direction and towards the middle of the container. Each taper defines an angle $\alpha$ between an inner surface and an outer surface of the outer wall. The method includes determining a nonzero value for angle $\alpha$ such that after hot isostatic pressing the top portion and the bottom portion of the container will deform to predetermined positions relative to the axial direction of the container.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of exemplary embodiments of the present invention, directed to one of ordinary skill in the art, is set forth in the specification, which makes reference to the appended figures, in which.

DETAILED DESCRIPTION

Figure 1:
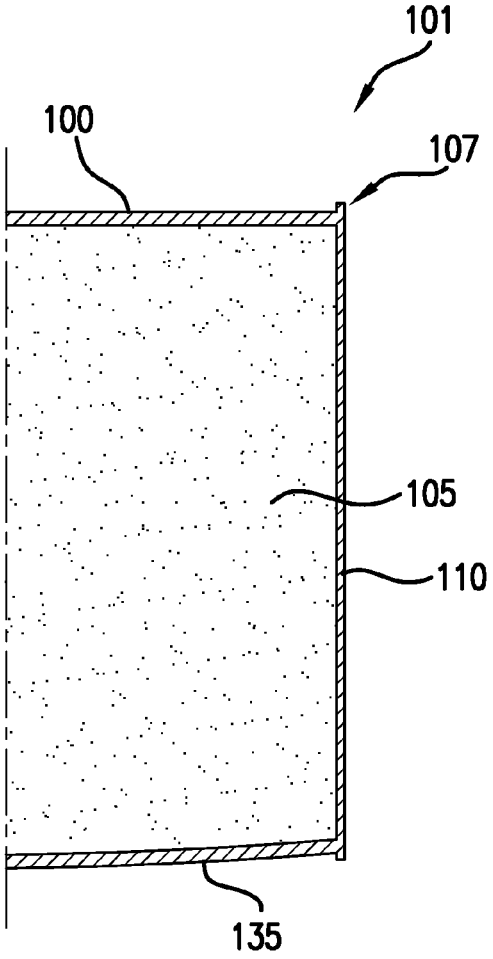
FIG. 1 is a schematic cross-section along one side of a container before subjection to a HIP process.

To provide advantageous improvements as described herein, the present invention provides an improved method and container for forming billets using hot isostatic pressing and controls the deformations of the container during the high temperatures and pressures experienced in such processing so as to provide a billet with a predetermined or selected shape. For purposes of describing the invention, reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

Figure 3:
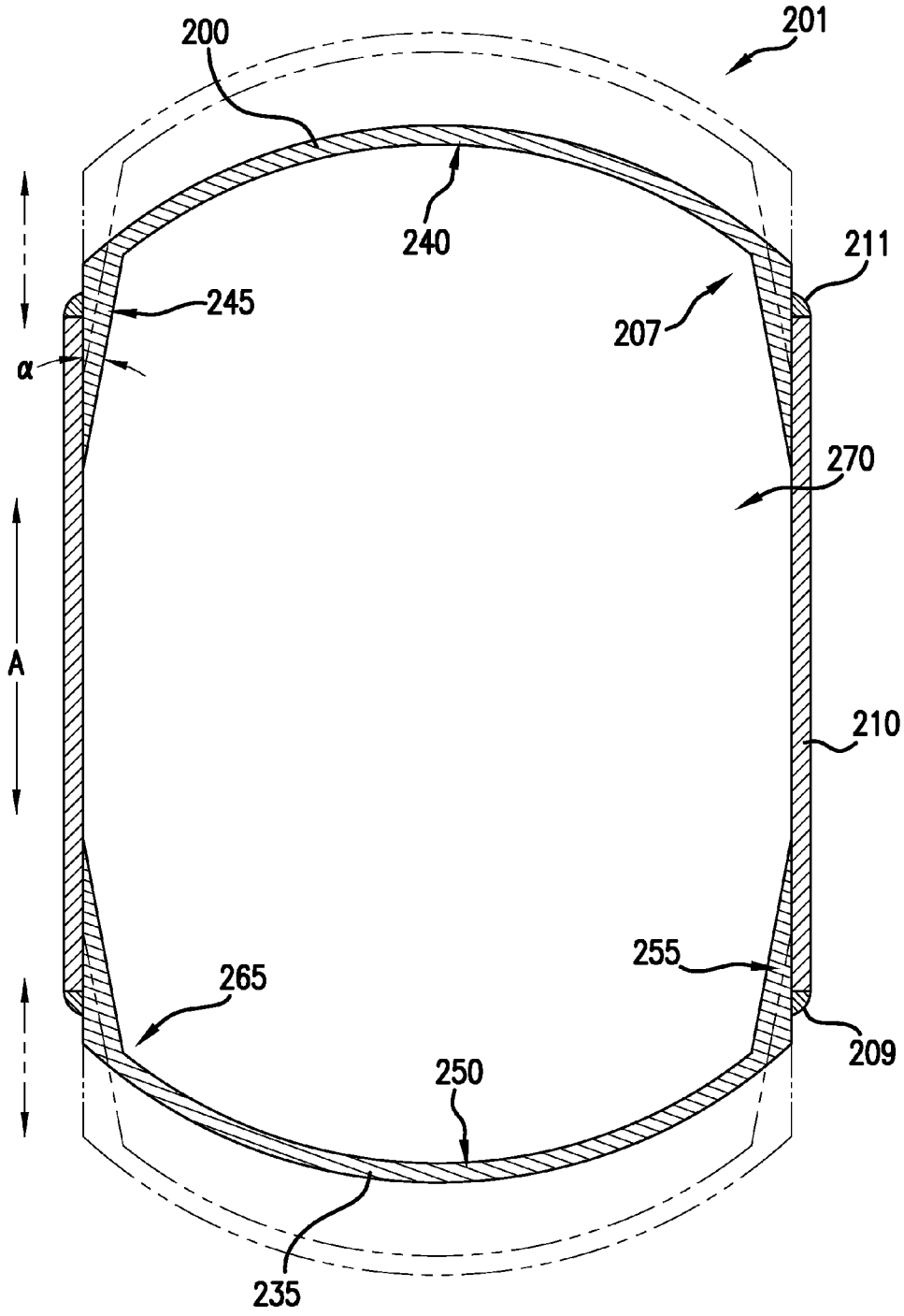
FIGS. 3, 4, and 5 are schematic cross-section views of exemplary embodiments of a container according to the present invention. Only one side of the container is depicted in each figure. The phantom lines illustrate the container after compaction processing.
Figure 4:
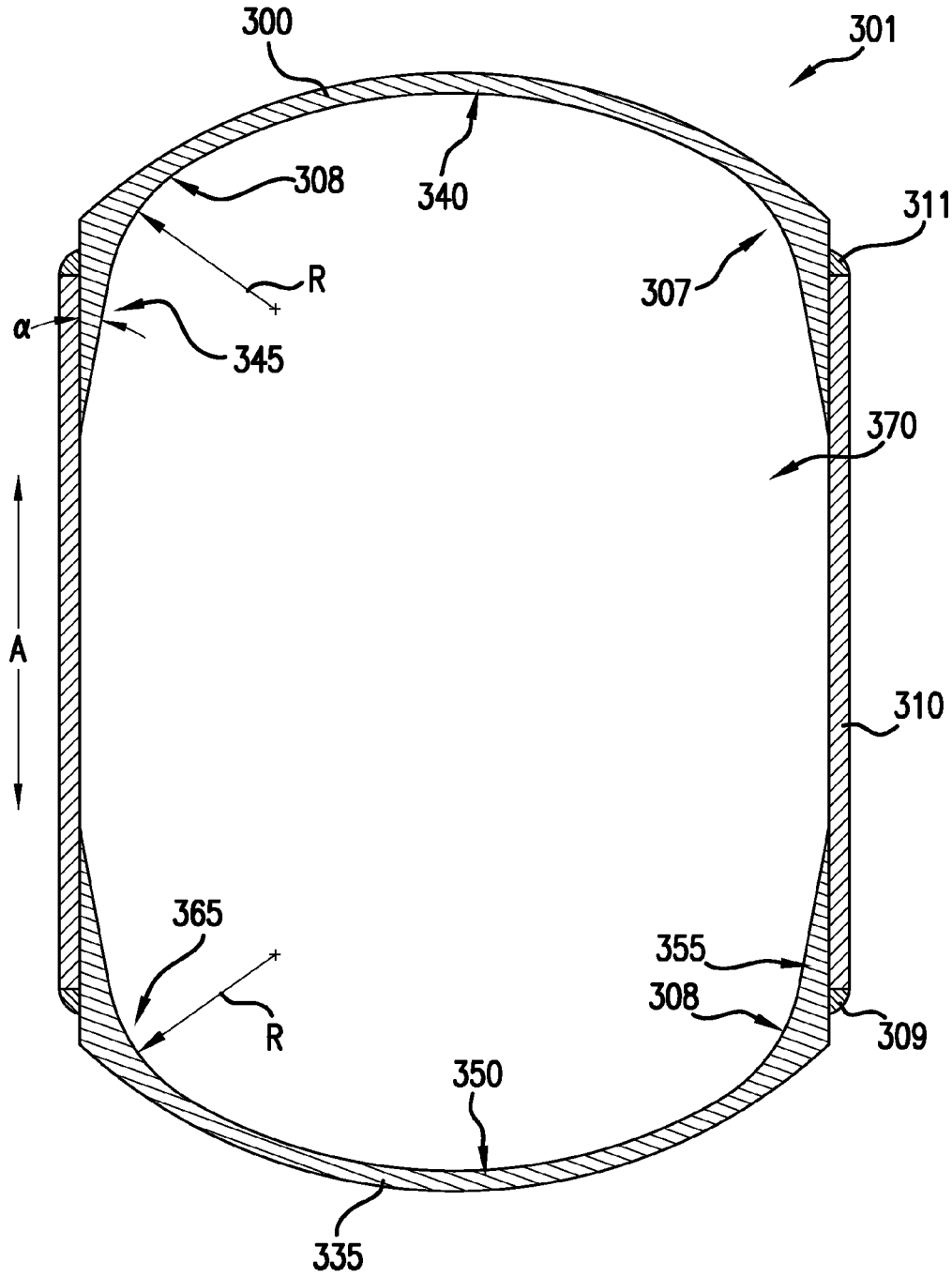
Figure 5:
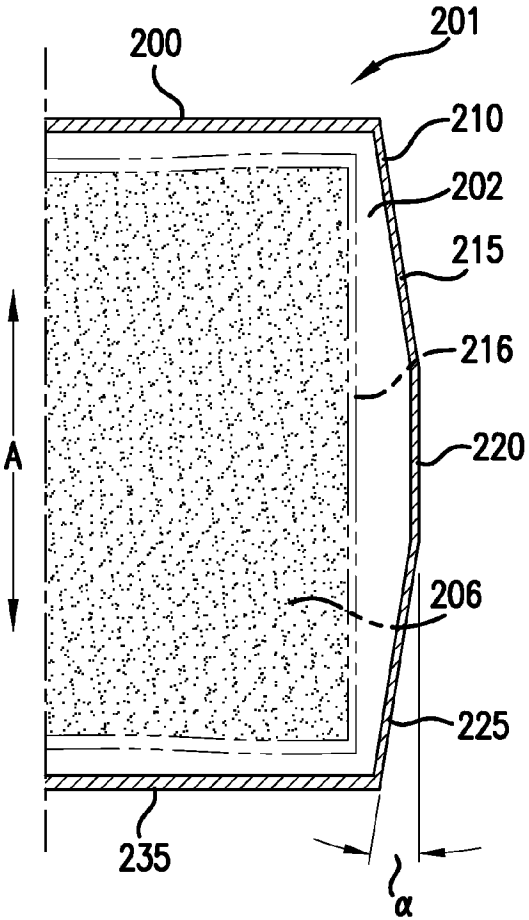
Figure 4:
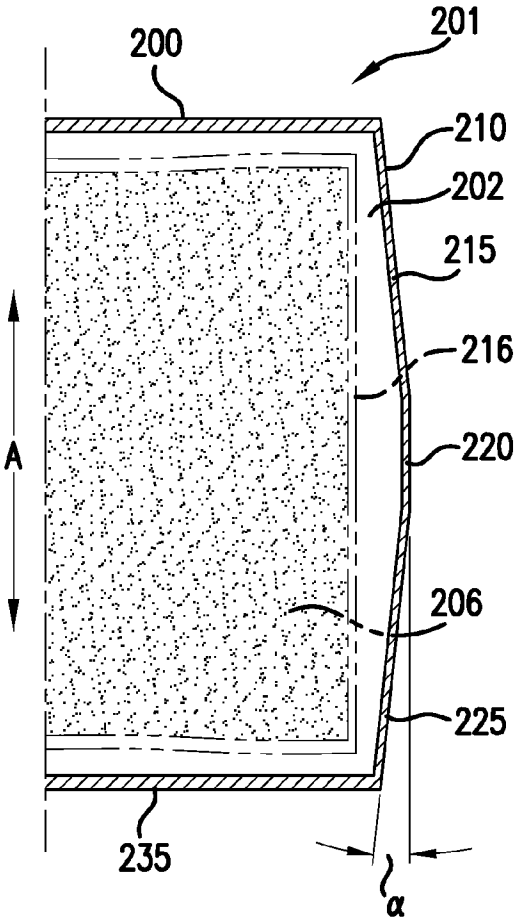
Figure 3:
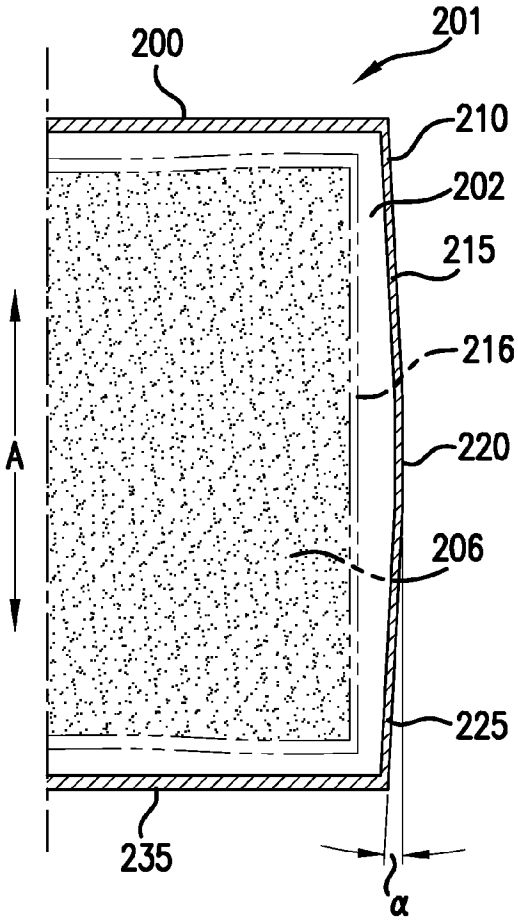

FIGS. 3, 4, and 5 illustrate exemplary embodiments of a container 201 constructed according to the present invention. In each figure, one side of container 201 is illustrated in cross-section. Container 201 has been constructed so that deformations that occur during compaction from the HIP process will result in a billet 206 having a substantially straight side 216, which also provides substantially parallel sides 216 for a cylindrically-shaped billet 206. The shape of container 201 after the deformation process is illustrated by phantom lines in FIGS. 3, 4, and 5.

Container 201 includes an outer wall 210 extending between container top 200 and container bottom 235 to define interior 202. The barrel-like shape of container 201 defines an axial direction A, which is used herein to define an angle $\alpha$ as will be described. Interior 202 receives a powder that is to be compacted during HIP processing into billet 206 having substantially parallel sides and/or a substantially cylindrical shape.

For this exemplary embodiment, the outer wall 210 of container 201 is divided into three portions including top portion 215, bottom portion 225, and a central portion 220 located between the top and bottom portions 215 and 225. The central portion 220 is defined by a portion of outer wall 210 that is substantially parallel to the axial direction A. Although not shown in the figures, central portion 220 could include e.g., a slightly arcuate shape to help control deformation during a HIP process.

As shown in FIGS. 3, 4, and 5, top portion 215 and bottom portion 225 are each positioned at a non-zero angle $\alpha$ to the axial direction A. The value for angle $\alpha$ is selected so that during compaction processing the deformation of outer wall 210 will result in the container 201 having substantially parallel sides 216, which will in turn provide the resulting billet 206 with parallel sides. More specifically, as the volume of the powder in container 201 decreases during a HIP process, walls 210 will be pushed inwardly towards the interior 202 of container 201. By selecting an appropriate angle α by which top and bottom portions 215 and 225 are angled outwardly before the HIP process, deformations during the HIP process will result in portions 215 and 225 moving towards the interior of container 201 such that, after the HIP process, angle α will be about zero so as to give billet 206 substantially parallel sides or a cylindrical shape. If desired, container 201 can now be machined or cut away from billet 206. Alternatively, as container 201 now retains the substantially uniform shape of billet 206, it may be desirable to leave container 201 in place for use on the intended work piece or final product.

Various angles α can be selected for use with container 201. For purposes of illustration, FIG. 3 provides an angle α of 3 degrees, FIG. 4 provides an angle α of 6 degrees, and FIG. 5 provides an angle α of 10 degrees. The value of angle α used for any particular application will depend on e.g., the amount of compaction expected, the properties of the powder, the geometry of container 201, and the material(s) and thicknesses used for the construction of container 201. For each application, the value of angle α is determined so that after HIP processing the top and bottom portions 215 and 225 will deform to predetermined positions. For example, the top and bottom portions 215 and 225 may be positioned away from the interior 202 of the container 201 such that after compaction the outer walls 210 of container 201 are substantially parallel. In such case, in certain embodiments angle α is typically in the range of between 0 and about 10 degrees. In still other embodiments, angle α is in the range of about 1 degree to about 10 degrees. However, other predetermined positions for the top and bottom portions 215 and 225 may be selected as well in order to provide the resulting billet 206 with a predetermined or selected shape. By way of example, angle α may be selected so that after deformation top portion 215 and/or bottom portion 225 provide an outer wall 210 that is concave, convex, or otherwise shaped as needed.

Figure 7:
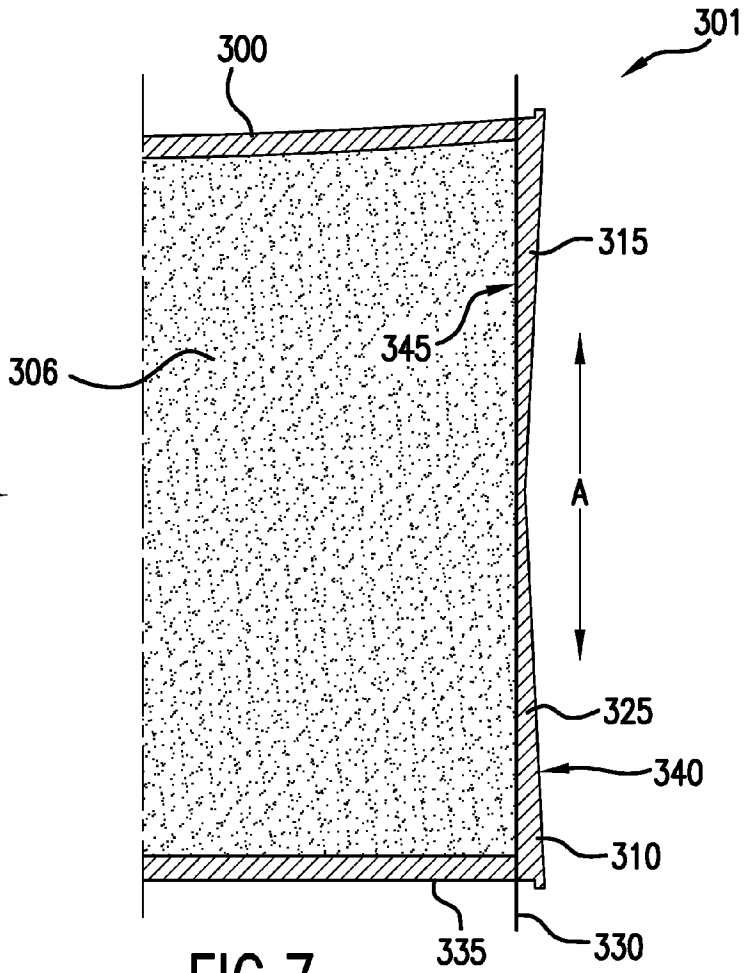
FIG. 7 is a schematic cross-section view of the exemplary embodiment of FIG. 6 after the container has been subjected to a HIP process.
Figure 6:
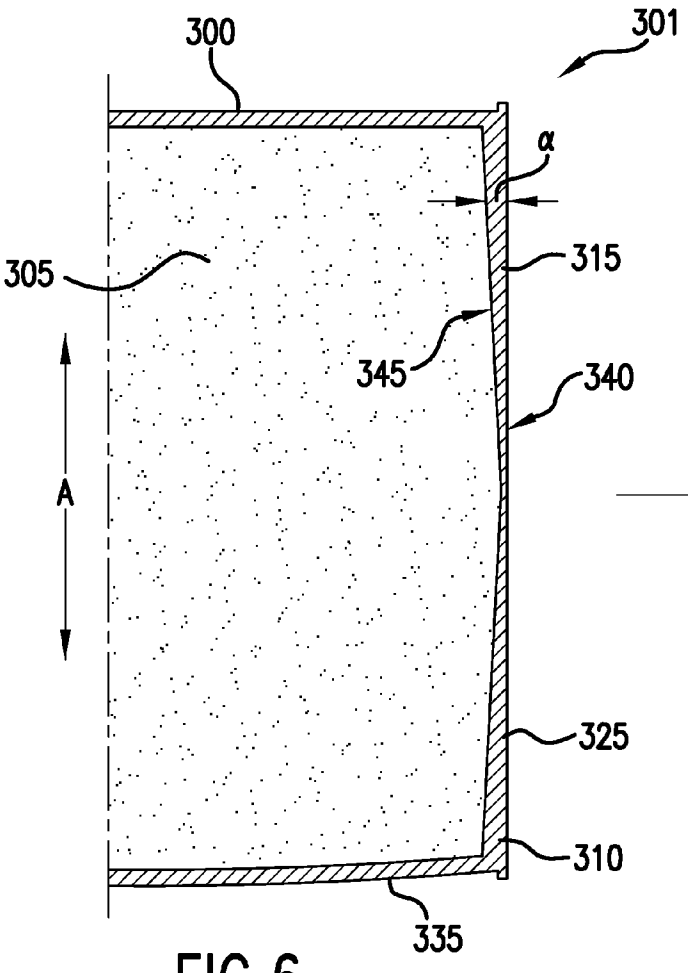
FIG. 6 is schematic cross-section view of an exemplary embodiment of a container according to the present invention. Only one side of the container is depicted.

FIGS. 6 and 7 illustrate additional exemplary embodiments of a container 301 constructed according to the present invention. In each figure, one side of container 301 is illustrated in cross-section. FIG. 6 represents container 301 before HIP processing while FIG. 7 illustrates container 301 after HIP processing. As with the embodiment of FIGS. 3-5, container 301 has been constructed so that deformations that occur during the compaction from the HIP process result in a billet 306 having a substantially straight side along inner surface 345 of container 301, which also provides substantially parallel sides for a cylindrically-shaped billet 306.

Container 301 includes an outer wall 310 extending between container top 300 and container bottom 335 to define an interior for powder 305 that is to be compacted during HIP processing into billet 306 having substantially parallel sides and/or a substantially cylindrical shape. For this exemplary embodiment, the outer wall 310 of container 301 is divided into two portions including top portion 315 and bottom portion 325.

As shown in FIG. 6, each portion 315 and 325 of outer wall 310 includes an outer surface 340 and an inner surface 345. Prior to deformation, outer surface 340 is substantially flat and parallel to the axial direction A of container 301 such that container 301 has a substantially cylindrical shape along outer surface 340. However, prior to deformation, inner surface 345 is at a non-zero angle α with respect to the axial direction A. More specifically, each portion 315 and 325 of outer wall 310 is tapered in that the inner surface 345 is at a non-zero angle α with respect to the axial direction A or the outside surface 340. The taper of each portion 300 and 335 is configured such that outer wall 310 decreases in thickness moving in a direction towards the middle of container 301 from either the top 300 or bottom 335.

Figure 2:
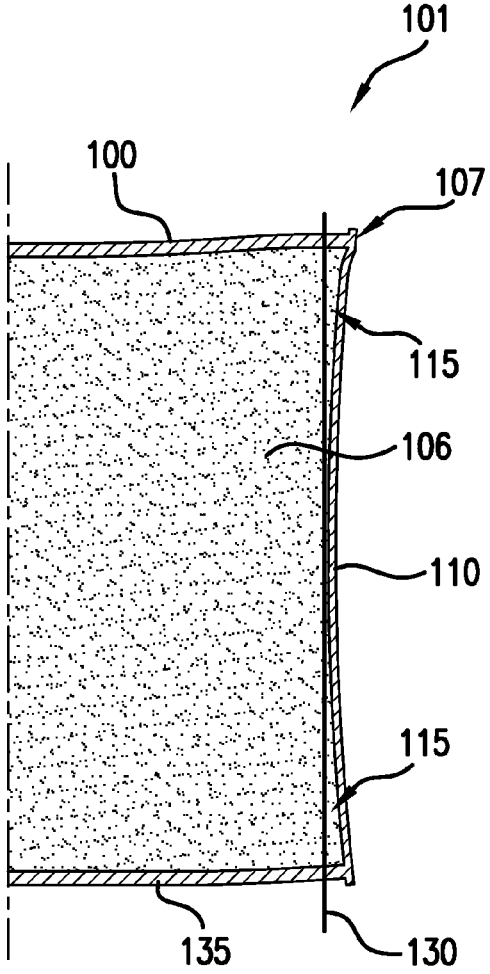
FIG.2 Prior Art
FIG. 2 is a schematic cross-section along one side of the container of FIG. 1 after undergoing the pressure and temperature of a HIP process.

As illustrated in FIG. 7, the value for angle α is selected so that after compaction processing the deformation of outer wall 310 will result in container 301 having an inner surface 345 that is substantially parallel to the axial direction A. More specifically, by selecting an appropriate angle α for the taper of the top portion 315 and bottom portion 325, deformations during the HIP process will result in portions 315 and 325 moving towards the interior of container 301 such that after the HIP process billet 306 will have substantially parallel sides or a cylindrical shape and a substantially straight profile along line 330. If desired, container 301 can now be machined or removed from the surface of billet 306 along line 330 with no or minimal loss of material from billet 306. As compared to the cut line 130 of FIG. 2, the savings in material can be substantial.

Various angles α can be selected for use with container 301. For purposes of illustration, FIG. 6 provides an angle α of about 3 degrees. However, the value of angle α used for any particular application will depend on e.g., the amount of compaction expected, the properties of the powder, the geometry of container 301, and the material(s) and thicknesses used for the construction of container 301. For each application, the value of angle α is determined so that after HIP processing the top and bottom portions 315 and 325 will deform to predetermined positions. In certain embodiments angle α is in the range of between 0 and about 10 degrees. In still other embodiments, angle α is in the range of about 1 degree to about 10 degrees. In addition, other predetermined positions for the top and bottom portions 315 and 325 may be selected as well in order to provide the resulting billet 306 with a predetermined or selected shape. By way of example, angle α may be selected so that after deformation top portion 315 and/or bottom portion 325 provide an outer wall 310 that is concave, convex, or otherwise shaped as needed.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A container for compaction processing of a powder into a billet, the container defining an axial direction, the container comprising:

a container top;

a container bottom; and an outer wall located between and connecting said container top and said container bottom to define an interior for the receipt of the powder, said outer wall having a top portion, a central portion, and a bottom portion, said central portion having a length along the axial direction that is less than a length along the axial direction of said top portion or said bottom portion, said top and bottom portions of said outer wall angled away from the interior of the container to form a non-zero angle α from the axial direction, wherein said angle α is in the range of about 1 degree to about 10 degrees so that after compaction processing said top and bottom portions will be located at predetermined positions to provide a selected shape for the billet.

2. A container for compaction processing of a powder as in claim 1, wherein said angle α is selected so that after compaction processing the billet has substantially parallel, substantially convex, or substantially concave sides along said outer wall of the container.

3. A container for compaction processing of a powder as in claim 1, wherein said central portion is substantially parallel to the axial direction.

4. A container for compaction processing of a powder into a billet, the container defining an axial direction extending lengthwise along the container, the container having a middle, the container comprising:

a container top;

a container bottom; and a cylindrically-shaped outer wall located between and connecting said container top and said container bottom to define an interior for the receipt of the powder, said outer wall having a length along the axial direction that is greater than the container top or the container bottom; said outer wall having a top portion and a bottom portion, each of said portions having a taper whereby the thickness of each said portion decreases along the axial direction and towards the middle of the container; said outer wall further comprising an inner surface and an outer surface along each of said portions, wherein said inner surface and said outer surface form an angle α between said inner and outer surfaces, said angle α being in the range of about 1 degree to about 10 degrees.

5. A container for compaction processing of a powder into a billet as in claim 4, wherein the taper of each said portion is configured such that the billet resulting from compaction processing has substantially parallel, substantially convex, or substantially concave sides along said outer wall of the container.

* * * * *